US006894473B1

(12) United States Patent
Le et al.

(10) Patent No.: US 6,894,473 B1
(45) Date of Patent: May 17, 2005

(54) FAST BANDGAP REFERENCE CIRCUIT FOR USE IN A LOW POWER SUPPLY A/D BOOSTER

(75) Inventors: Binh Quang Le, San Jose, CA (US); Cathy Thuvan Ly, Santa Clara, CA (US); Lee Cleveland, Santa Clara, CA (US); Pau-Ling Chen, Saratoga, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 115 days.

(21) Appl. No.: 10/379,744

(22) Filed: Mar. 5, 2003

(51) Int. Cl.[7] ..... G05F 3/16

(52) U.S. Cl. ..... 323/314; 323/315; 327/539; 327/541; 327/542

(58) Field of Search ..... 323/304, 311, 323/313–315; 327/538–543

(56) References Cited

U.S. PATENT DOCUMENTS

| | | | | |
|---|---|---|---|---|
| 5,349,286 A | | 9/1994 | Marshall et al. | |
| 5,783,935 A | * | 7/1998 | Kyung | 323/313 |
| 5,920,185 A | * | 7/1999 | Ozoe | 323/315 |
| 6,043,637 A | * | 3/2000 | Suzu | 323/313 |
| 6,100,677 A | | 8/2000 | Farrenkopf | |
| 6,528,978 B2 | * | 3/2003 | Lim | 323/313 |
| 2003/0067291 A1 | * | 4/2003 | Hong | 323/315 |

OTHER PUBLICATIONS

"Introduction to Bandgap Reference Generators", Lecture Notes for E:LEN 689–602, Fikret Dulger, 18 pgs., no date available.

"Low Voltage, Low Power CMOS Bandgap References", ECE1352—Reading Assignment, University of Toronto, Professor K. Phang and Timothy Lo, 20 pgs., no date available.

"The Design of Band–Gap Reference Circuits: Trials and Tribulations", National Semiconductor, 9 pgs., taken from the Internat at : http://www.national.com/rap/Application/0,1570,24,00.html.

* cited by examiner

*Primary Examiner*—Gary L. Laxton
(74) *Attorney, Agent, or Firm*—Eschweiler & Associates, LLC

(57) ABSTRACT

A bandgap reference circuit includes a current generation circuit connected to a voltage generation circuit connected to a smart clamping circuit, and a discharge circuit connected to the current generation circuit and the voltage generation circuit. The discharge circuit initially discharges a potential in the current and voltage generation circuits to improve repeatability. A start circuit within the current generation circuit then initializes the reference output at about the supply voltage to improve the speed and settling time of the output signal. The current generation circuit sources a current to the voltage generation circuit that translates the current having a positive function of temperature $+T_C$ into a reference voltage. The smart clamping circuit further generates a clamping voltage having a negative function of temperature $-T_C$ and a load resistance. The clamping voltage and the load resistance are applied across the reference voltage quickly reducing the reference voltage particularly at high temperatures and during start-up to a final level, thereby producing a fast and stable reference voltage.

23 Claims, 5 Drawing Sheets

FAST BANDGAP REFERENCE CIRCUIT FOR USE IN A LOW POWER SUPPLY A/D BOOSTER

FIELD OF INVENTION

This invention relates to electronic circuits and more particularly relates to voltage and current reference circuits.

BACKGROUND OF THE INVENTION

Voltage and current reference circuits find many applications in electronic circuits including Flash and other types of electronic memory device applications. The bandgap reference circuit is a common circuit solution for supplying a voltage or current reference for such applications. FIG. 1 is a prior art bandgap circuit 100 and operates generally as follows. P1 and P2 act as a standard MOS current mirror providing current to Q1 and Q2 which are configured as a bipolar current mirror. Q1 and Q2 are sized differently; therefore, although they conduct the same current, they have different current densities. Therefore, there will be a difference in their $V_{be}$ voltages and the difference will be reflected in the current through R1. VREF is a voltage reference that is a function of the current through R2 and the base-emitter voltage $V_{be}$ of Q3. Since the current through R2 is mirrored from P1 it is seen that the current through P3 is a function of $\Delta V_{be}$ between Q1 and Q2 and R1. Therefore, VREF is a function of the $\Delta V_{be}$ between Q1 and Q2, the ratio in resistor values R1 and R2, and $V_{be}$ of Q3. The current mirror insures equal currents through Q1 and Q2. Note that Q1 is n times bigger than Q2, thus:

$$\Delta V_{be}=V_{BE,Q2}-V_{BE,Q1}=V_T In(I_C/I_S)-V_T In(I_C/nI_S)=k(T/q)In(n).$$

$\Delta V_{be}$ exhibits a positive temperature coefficient ($+T_C$). If the positive temperature coefficient of $\Delta V_{be}$ is combined with $V_{BE,Q3}$, which has a negative temperature coefficient ($-T_C$), along with the correct weighting ratios of R1 and R2, VREF will have approximately a zero temperature coefficient, and VREF will be independent of temperature. This ratio is determined by taking the equation for VREF that incorporates all temperature dependencies, differentiating with respect to temperature, and setting the equation equal to zero. For example, from FIG. 1, we can calculate VREF as:

$$VREF=V_{BE,Q3}+R2(mI_C)=V_{BE,Q3}+R2(m\Delta V_{be}/R1)=V_{BE,Q3}+m(R2/R1)In(n)kT/q \quad (1)$$

and:

$$\partial VREF/\partial T=\partial V_{be}/\partial T+m(R2/R1)In(n)k/q \quad (2)$$

As discussed, to have a reference that is substantially independent of temperature, equation (2) should be zero, or:

$$\partial VREF/\partial T=\partial V_{be}/\partial T+m(R2/R1)In(n)k/q=0 \quad (2)'$$

If we assume a typical value of positive temperature coefficient for $\partial V_{be}/\partial T$:

$$\partial V_{be}/\partial T=-1.5\ mV/^\circ K$$

When this value is substituted into equation 2', and solved for VREF, a new value for VREF is obtained having a zero temperature coefficient, where:

$$VREF=1.25V$$

This is well known by those skilled in the art of bandgap reference circuits.

The above explanation of prior art circuit 100 of FIG. 1 assumes that the gain-bandwidth product of the reference circuit, temperature, operating speeds, and manufacturing tolerances remain within limited bounds. However, in many cases, this is not a valid assumption. Often, integrated circuits must operate at, for example, combinations of high speeds, extreme temperatures, extreme process corners, and low voltages. Under some of these conditions, the gain-bandwidth product of the reference circuit may be inadequate.

Additionally, as device densities and speed requirements continue to increase, the speed requirement of the bandgap reference circuit may need to increase to keep pace with the remainder of the circuit, including a bandgap reference circuit used to supply, for example, the reference voltage for a voltage booster of a memory circuit. Further, as supply voltage levels decrease due to these higher density architectures, device speed requirements may be increasingly difficult to obtain, particularly at low supply voltage and reference levels, and at low operating currents over wide operating temperatures.

It should also be noted that in the typical bandgap reference circuit of FIG. 1, the current mirror is usually in the cascode form to reduce the variation of VREF with respect to the supply voltage $V_{CC}$. The particular arrangement of bandgap voltage reference of FIG. 1, however, can not be used directly for the high speed boosters being considered, because of reduction in the gain-bandwidth product of the reference at higher speeds and low power supply voltages. Accordingly, there is a need to provide a means of compensation that reduces the negative effects of a low $V_{CC}$ supply voltage applied to a bandgap reference circuit operating at high speeds and low power supply and reference levels, while accommodating a wide range of temperature and process variations.

SUMMARY OF THE INVENTION

The following presents a simplified summary of the invention in order to provide a basic understanding of some aspects of the invention. This summary is not an extensive overview of the invention. It is intended neither to identify key or critical elements of the invention nor to delineate the scope of the invention. Rather, its primary purpose is to present some concepts of the invention in a simplified form as a prelude to the more detailed description that is presented later.

The present invention relates to an electronic circuit and a method for producing a fast reference voltage or reference current. A bandgap reference circuit includes a current generation circuit connected to a voltage generation circuit that in turn is connected to a smart clamping circuit. A discharge circuit is further connected to the current generation circuit and the voltage generation circuit. The bandgap reference circuit may be used to supply, for example, the reference voltage for a voltage booster in a memory circuit. The discharge circuit initially discharges a residual potential in the current and voltage generation circuits to improve repeatability.

A start circuit within the current generation circuit then initializes the reference output to about the supply voltage to improve the speed and settling time of the output signal. The current generation circuit sources a current to the voltage generation circuit that translates the current that is proportional to a temperature into a reference voltage signal (FVREF). The smart clamping circuit limits the reference voltage at high temperatures, for example, with a clamping voltage and a load resistance across the reference voltage.

The clamping voltage and the load resistance quickly lowers the reference voltage FVREF to the final level, thereby producing a stable, fast reference voltage signal FVREF that is substantially independent of supply voltage and process variations.

According to one aspect of the present invention, the discharge circuit comprises MOS transistors connected to the circuit ground for discharging any residual potentials which may remain in the current and voltage generation circuits. This feature improves the settling time and repeatability of the output reference voltage FVREF.

In another aspect of the invention, the current generation circuit comprises a current mirror circuit comprising a cascode arrangement of first and second bipolar and first and second MOS transistors along with a first resistance.

In yet another aspect of the invention, the first resistance of the current generation circuit comprises a poly resistor without silicide that has a negative temperature coefficient. This provides a reference current having a positive function of temperature to lower the effective $\partial V_{be}/\partial T$, which advantageously lowers the FVREF to keep the voltage generation circuit operating in saturation particularly at low supply voltages, thereby providing voltage reference stability.

In still another aspect of the present invention, a smart clamping circuit comprises one or more diode-connected transistors and a resistor that are connected across the output of the voltage generation circuit forming the output of the bandgap reference circuit. The clamping circuit provides a clamping voltage and a load resistance, that operates to provide a reference clamping function at high temperatures. The clamping voltage and the load resistance, quickly limit and lower the reference voltage output FVREF to the final value. The presence of the clamp, although affecting the final value of FVREF, provides a fast and stable reference voltage over a wide range of temperature and supply voltage variations.

The aspects of the invention find application in devices that include, for example, high speed voltage booster circuits requiring lower reference voltages and operating at low supply voltage or low supply current levels, while accommodating a wide range of supply voltages, temperatures and process variations.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
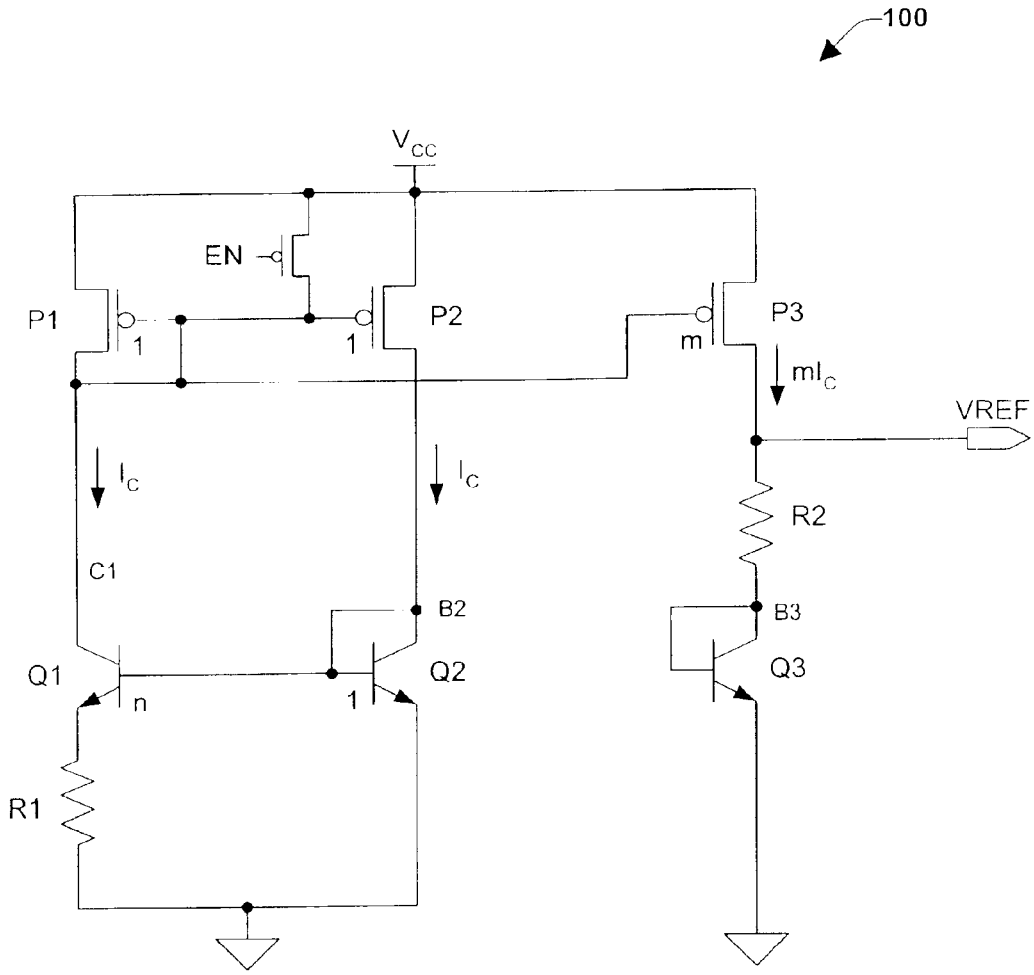
FIGURE 1 PRIOR ART
FIG. 1 is a schematic diagram illustrating a prior art bandgap voltage reference circuit 100.

The present invention will now be described with reference to the drawings, wherein like reference numerals are used to refer to like elements throughout. The present invention relates to an electronic circuit for producing a fast voltage or current reference which is substantially independent of $V_{CC}$ fluctuations, and which may be used, for example, to provide a fast low level reference voltage for a voltage booster for the read mode operations of memory cells. The invention comprises current and voltage generation circuits, a smart clamping circuit, and a discharge circuit.

Figure 2:
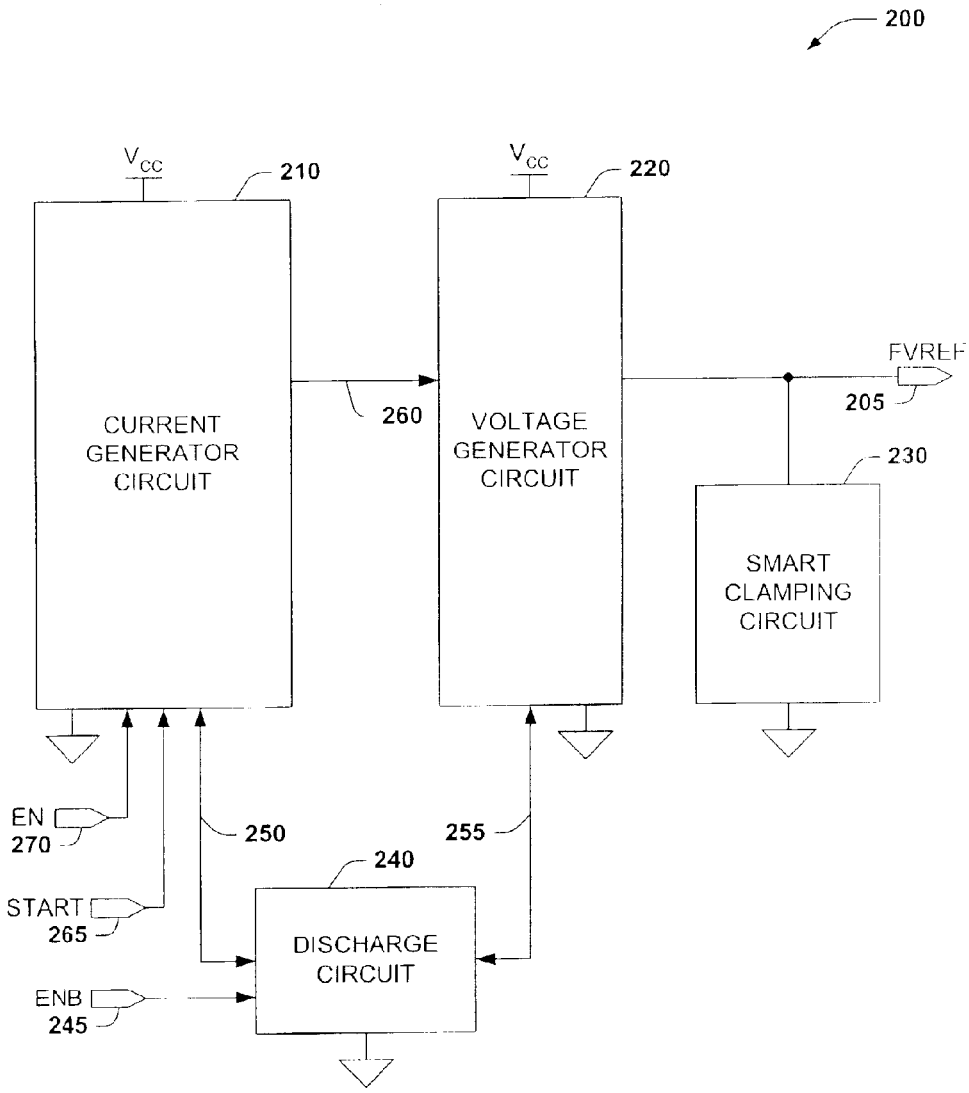
FIG. 2 is system level functional block diagram illustrating an exemplary fast bandgap voltage reference circuit 200, in which various aspects of the invention may be carried out.

FIG. 2 illustrates a system level functional block diagram of an exemplary fast bandgap voltage reference circuit 200, for producing a fast voltage reference FVREF 205, which may be used, for example, to provide a fast settling low level reference voltage for a voltage booster for the read mode operations of memory cells. Fast bandgap circuit 200 comprises a current generation circuit 210, a voltage generation circuit 220 connected to the current generation circuit 210, a smart clamping circuit 230 connected to the voltage generation circuit 220, and a discharge circuit 240 connected to the current generation circuit 210 and the voltage generation circuit 220. A further understanding of this functional block diagram will be explained in greater detail in connection with FIG. 3 and following.

Returning to FIG. 2, the $V_{CC}$ power supply and circuit ground is applied to the bandgap fast voltage reference circuit 200, to supply power for the reference operation. $V_{CC}$ variations are conventionally regulated by the current mirror circuit within the current generation circuit 210 as previously discussed to generate a reference voltage FVREF 205 that is substantially independent of variations in $V_{CC}$.

Initially, discharge circuit 240, comprising, for example, two MOS transistors or other switching elements coupled to circuit ground, provide a discharge path for a residual potential or charge that may be present in the voltage and current generator circuits 210, 220 to improve repeatability in the generation of the reference voltage. The discharge circuit 240, activated by the enable bar signal (ENB) 245, discharges any residual potential in the current generation circuit 210 via discharge line 250, and a residual potential in the voltage generation circuit via discharge line 255 to circuit ground. Discharge circuit 240 provides repeatable operation each time the reference circuit is started, and a predictable settling time whether the circuit was recently activated, or after a long period of inactivity.

The current generation circuit 210 receives enable signal EN 270 to begin operation, while a start circuit, enabled by a START signal 265 (e.g., provided by a control circuit that is not shown), within the current generation circuit 210 initializes the reference output FVREF 205 at about the supply voltage $V_{CC}$ to improve the speed and settling time of the output signal. The current generation circuit 210 sources a stable reference current 260 having a functional relationship to temperature to the voltage generation circuit 220. In the industry, another phrase is coined which states that a given value is "proportional to the absolute temperature" (PTAT). Although a "proportional" or "proportionality" term may also be used in some instances to describe the relationship between the temperature and a resistance, current, or voltage of the reference circuit, a "functional relationship" type term will generally be used herein, in the context of the present invention, to gain a broader contextual relationship. However, the use of either term, is not intended to be construed in any limiting sense. Note: the absolute temperature in accordance with the present invention generally refers to a temperature measured in degrees Kelvin (° K) relative to absolute zero (e.g., −273° C.).

In the present invention, for example, the current generation circuit 210 generates a current having a positive function of temperature (e.g., a positive temperature coefficient, or $+T_C$). Thus, as the temperature increases, for example, the current also increases. The voltage generator 220 then translates the $+T_C$ reference current 260 from the current generator 210 into a reference voltage FVREF 205.

To quickly bring the reference voltage FVREF 205 to its final value, a smart clamping circuit 230 is also provided. Smart clamping circuit 230, in one example, applies to the reference voltage FVREF 205 a load resistance, for example, and a clamping voltage in response to a high temperature. The high temperature clamping voltage and load resistance are chosen and trimmed, respectively, to produce the final reference voltage FVREF 205 more quickly than would otherwise occur at high temperatures without substantially affecting the final value. Thus a stable, fast reference voltage signal FVREF 205 is provided that is substantially independent of supply voltage $V_{CC}$ and process variations.

In the following FIGS. 3–5 a schematic diagram, timing diagram and method flow diagram illustrate an exemplary fast bandgap voltage reference circuit similar to the functional block diagram described above for the fast band gap voltage reference circuit 200 of FIG. 2. Although the fast bandgap reference circuit is shown and described herein with respect to a voltage reference circuit, a current reference circuit is also anticipated as falling within the scope of the present invention.

Figure 3:
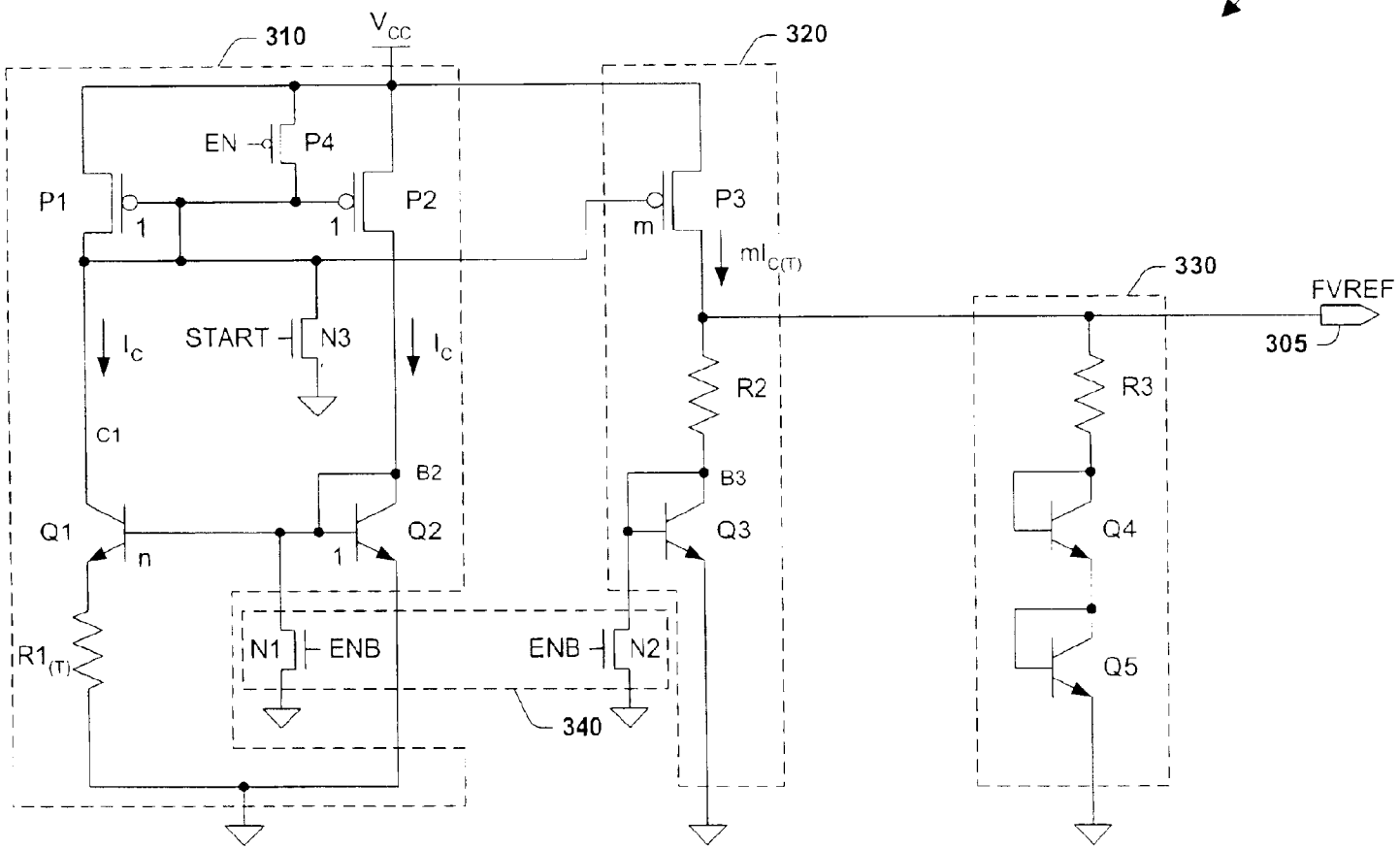
FIG. 3 is schematic diagram illustrating an exemplary fast bandgap voltage reference circuit 300, in accordance with an aspect of the invention.

FIG. 3 illustrates an exemplary fast bandgap voltage reference circuit 300, in accordance with an aspect of the invention. Voltage reference circuit 300, may be used to provide a low supply voltage, fast reference voltage FVREF 305 for a voltage booster used for the read mode operations of memory cells as well as in other applications, and operates similar to that described in FIG. 2. Reference circuit 300 of FIG. 3 comprises a current generation circuit 310, a voltage generation circuit 320 connected to the current generation circuit 310, a smart clamping circuit 330 connected to the voltage generation circuit 320, and a discharge circuit 340 connected to the current generation circuit 310 and the voltage generation circuit 320.

The voltage reference circuit 300 is enabled with an enable signal EN while the complimentary enable bar signal ENB is used to initiate discharging any residual potential in the current generation circuit 310 at circuit node B2 and the voltage generation circuit 320 at circuit node B3. The voltage reference circuit 300 operation again begins within the current generation circuit 310 with a START signal which initializes the reference output FVREF 305 at about the supply voltage $V_{CC}$ to improve the speed and settling time of the output signal.

Designing a fast low level reference voltage FVREF 305 (e.g., about 1.25V), is difficult when the supply voltage $V_{CC}$ is also low (e.g., about 1.6V or less). At extreme process corners and temperatures, for example, the PMOS transistor P3 can go out of the saturation region. Thus, to keep P3 biased into saturation at these low power supply voltages, the inventors of the present invention appreciated that the reference voltage FVREF 305 should also be reduced. According to the present invention, the FVREF 305 voltage level may be reduced by reducing the "effective" $|\partial V_{be}/\partial T|$, which is the effective partial differential of the base emitter voltage with respect to temperature. This is done by designing the current $I_C$ to be functionally related to the temperature. The reference current $I_C$ can be calculated as:

$$I_C=\Delta V_{be}/R1=((kT/q)In(n))/R1 \quad (3)$$

As the silicon bandgap may be impractical to change, the inventor realized from equation (3) that the current $I_C$ may instead, be given this functional relationship to temperature in two ways: by making R1 in the denominator functionally related to the temperature, and by the temperature T in the numerator. For example, to provide a positive temperature coefficient ($T_C$) reference current $I_C$, a negative temperature coefficient ($-T_C$) resistor R1 may be used in the current generation circuit 310 to provide a stable reference current $I_C$ in response to the resistor R1. To produce a resistance with a negative temperature coefficient, the inventor has used, for example, a poly resistor without silicide that yields a FVREF 305 level of 1.17V with a generally zero $T_C$. At this FVREF level, the P3 transistor can be biased into saturation at a $V_{CC}$ of 1.6V, as long as the gate drive of the diode-connected transistor P1 is less than:

$$1.6V-1.17V=0.43V$$

This condition can be satisfied by choosing the size of transistors P1 and P2 to be sufficiently large.

Thus, the FVREF circuit 300 of the present invention may be used, for example, to provide a high speed reference with an accuracy of +/−40 mV in a high speed voltage booster circuit. In high speed applications of this type, the accuracy may often be traded for the speed of such a reference voltage.

According to another aspect of the present invention, the inventor realized that the settling time of the output voltage FVREF 305 may be shortened by initializing FVREF at about $V_{CC}$. By contrast to a prior art voltage reference circuit, when the VREF is started at ground voltage, AC performance may be poor as the output voltage typically transitions a greater voltage differential to the final output voltage. The inventor has recognized that at extreme process variations, temperature and power supply ranges, a voltage reference circuit can have significant overshoot or undershoot which makes the repeatability of FVREF at these extreme conditions difficult.

Therefore, the inventor has found that by initializing FVREF at about $V_{CC}$, that FVREF behaves much more similarly (e.g., going from $V_{CC}$ down to about 1.17V) at these extreme conditions. The START signal used (e.g., START of FIG. 4), is a pulse of about 2–3 ns, for example, and is applied to the START transistor. With the START signal, the START transistor momentarily grounds the gates of P1, P2, and P3, forces P1, P2, and P3 into full conduction, and momentarily forces the output voltage FVREF 305 to about $V_{CC}$.

Accordingly, the reference voltage settles down to the final reference level more quickly than with a prior art circuit that starts from the ground potential and must rely on the reference current to pull the reference voltage up to the final reference voltage. This technique requires less time predominately because the supply voltage is closer to the final reference voltage than the circuit ground voltage.

The voltage generator 320 is connected to the current generator 310 translating the $+T_C$ reference current $I_C$ into a reference voltage FVREF 305. As previously described, the reference current $I_C$ in the reference current generator 310 is mirrored as mic in the voltage generator 320 through P3, R2, and Q3 to produce the reference voltage FVREF 305 (wherein m represents a size of P3). The value of FVREF may further be adjusted within the process variations by trimming resistor R2. Thus, according to the present invention, the "effective" $|\partial V_{be}/\partial T|$, is made smaller because the reference current $I_C$ has a $+T_C$ due to the $-T_C$ characteristic designed into resistor R1. (see equation 3 above, having R1 in the denominator).

Although mirror current $mI_C$ through P3 increases at high temperatures, the smart clamping circuit 330 clamps the reference voltage FVREF to a final reference voltage level. The smart clamping circuit 330 brings FVREF quickly to the final level, especially at high temperature, because the $V_{BE}$ of the bipolar transistors decreases when temperature increases. Resistor R3 is used to fine-tune the clamp value. Resistor R3, therefore, lessens the effect of the clamp on the final value of FVREF. In this way, according to the present invention, the smart clamping circuit 330 quickly settles the reference voltage FVREF 305 to a stable final value over a wide range of supply voltages at high temperatures.

The series combination of diode-connected transistors Q4 and Q5 strongly pull down FVREF toward the final value when FVREF is close to $V_{CC}$, particularly at the higher temperatures where the clamp circuit is most needed. The inventor has found that by adjusting R3, the error caused by the clamp can be controlled within 20 mV of a target reference voltage and still provide its function.

The discharge circuit 340, comprising, for example, two NMOS transistors coupled to circuit ground, provide an initial discharge path for a residual potential or charge that may be present in the current generation circuit 310 at circuit node B2 and the voltage generation circuit 320 at circuit node B3. The discharge circuit 340 provides repeatable operation each time the reference circuit is started, and a predictable settling time whether the circuit was recently activated, or after a long period of inactivity. The MOS discharge transistors are activated by the enable bar signal ENB.

The functionality of circuit 300 of FIG. 3 is now generally described. In the current generator 310, P1 and P2 form a current mirror. Since they have the same W/L transistor size ratios they source the same amount of current. Q1 and Q2 also form a current mirror. However, Q1 and Q2 are sized differently (Q1, in this embodiment, is n times larger than Q2) to provide different current densities. Thus the current density J2 of Q2 is n times larger than the current density J1 in Q1. The difference in current density provides a difference in the base-emitter voltage $V_{be}$ of Q1 and Q2. Since:

$$V_b(Q1)=V_b(Q2),$$

then $$V_{be}(Q2)=V_{be}(Q1)+I_C(Q1)*R1$$

or, $$\Delta V_{be}=V_{be}(Q1)-V_{be}(Q2)=I_C(Q1)*R1$$

Therefore, the difference in base-emitter voltages of Q1 and Q2 is shown by the voltage existing across R1. In addition to the $+T_C$ of the $\Delta V_{be}$, a $-T_C$ resistor is used for R1 to provide a $+T_C$ characteristic in $I_C$ and $mI_C$, which permits a lower reference output voltage FVREF 305 to keep P3 in saturation at low supply voltages. The start circuit comprises an NMOS transistor N3 enabled by start signal START in the present example, to force full conduction of P1—P3 for starting the FVREF output at about $V_{CC}$ for faster settling times and lower operating current $I_C$.

The current $I_C$ supplied by P1 to Q1 is mirrored to P3 within the voltage generator circuit 320. Since, in this particular embodiment, P3 and P1 have a W/L size ratio of m/1, P3 conducts a current of $mI_C$. P3 feeds R2 and Q3 which provide a voltage drop across R2 and a $V_{be}$(Q3) voltage drop across Q3 because Q3 is biased as a diode.

The enable signal EN drives a PMOS transistor P4 to enable the reference circuit 300. The enable bar signal ENB (the EN complement) is received by, for example, two NMOS transistors N1 and N2 of the discharge circuit 340 to discharge any residual voltage potential or charge remaining at the B2 circuit node of the current generator 310 and B3 circuit node of the voltage generator 320. The discharge circuit maintains consistent, repeatable results of the output voltage VREF 305 over large extremes of temperature, process variations, and supply voltage.

In the smart clamping circuit 330, two diode-connected transistors Q4 and Q5 supply the clamping voltage for the reference voltage at higher temperatures, while series resistor R3 lessens the impact of the clamp to the final value of FVREF 305. Thus, a bandgap reference voltage is provided for fast low supply voltage applications that are substantially independent of extremes of temperature, process variations, and supply voltage.

Figure 4:
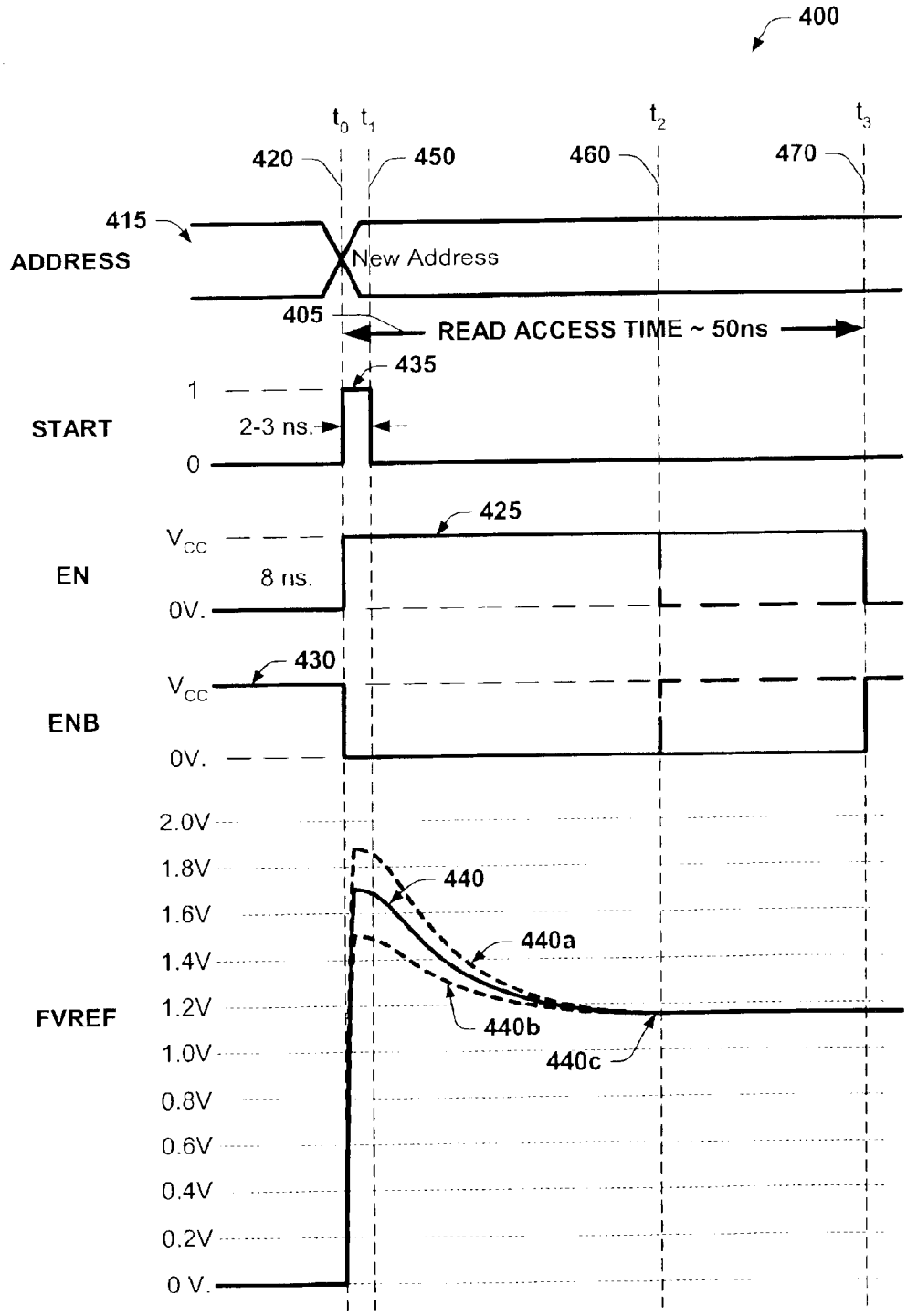
FIG. 4 is a simplified timing diagram 400 illustrating exemplary read mode timings and output of the fast bandgap voltage reference of FIG. 3.
Figure 5:
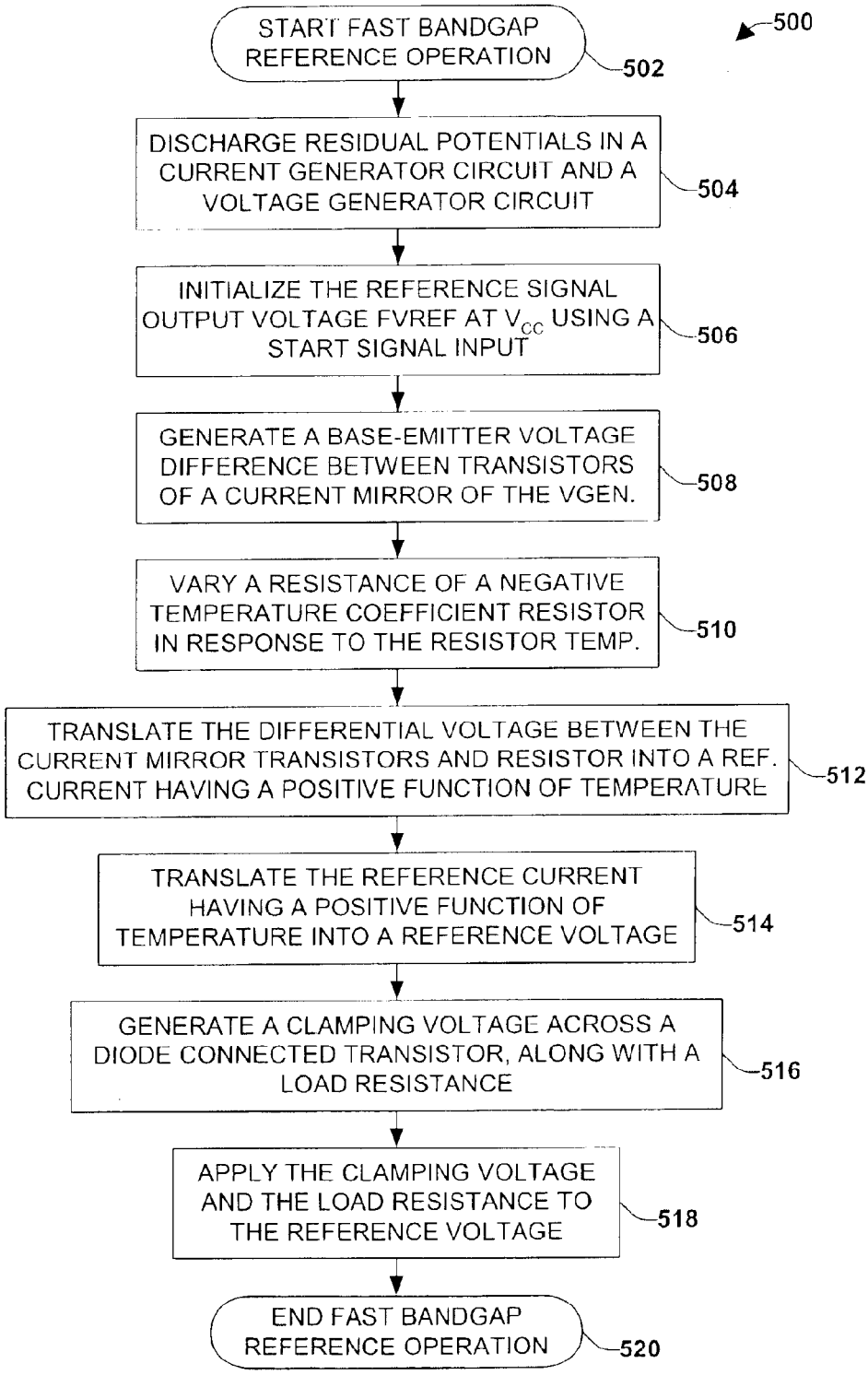
FIG. 5 is a flow diagram 500 illustrating an exemplary method for a fast bandgap reference operation in association with an aspect of the present invention.

FIG. 4 demonstrates an exemplary timing diagram 400 for exemplary read mode timings and output of the fast bandgap voltage reference circuit 300 of FIG. 3. The timing of the voltage reference 300 of FIG. 3 is relative to that of the read access timing 405 which is about 50 ns as depicted in the timing diagram 400 of FIG. 4.

Prior to a new read access 405 of a new address 415 which begins at time $t_0$ (420), the enable signal EN 425 applied to the reference circuit 300 is low, while its' complimentary signal, enable bar ENB 430 is high. While EN 425 is low, the enable PMOS transistor in the current generator 310 pulls the gates of PMOS transistors P1, P2, and P3 to $V_{CC}$ holding P1, P2, and P3 in an off-state. Simultaneously, complimentary signal ENB 430 applied to the two NMOS transistors of the discharge circuit 340 is high, forcing the bases of Q1 and Q2 at circuit node B2, and the base of Q3 at circuit node B3 to discharge any remaining residual potential which may remain from a last reference circuit operation. This reset, or pre-discharge type feature maintains repeatable circuit performance over wide ranges of supply voltage, temperature, and process variations, as well as a wide range of circuit idle periods.

At time $t_0$ (420), EN 425 goes high enabling the current generator 310 and the voltage generator 320, while complimentary signal ENB 430 goes low to remove the discharge condition from these circuits. Since speed is a high priority during the read operations, the inventors have also taken advantage of the START timing portion of the present invention, wherein the START signal 435 applies a high going pulse of about 2–3 ns to the NMOS START transistor N3 within the current generator circuit 310. The NMOS START transistor N3 momentarily pulls the gates of PMOS transistors P1, P2, and P3 to circuit ground, forcing P1, P2, and P3 into full conduction, and momentarily pulls the output voltage FVREF (305 of FIG. 3, and 440 of FIG. 4) to about $V_{CC}$ (e.g., about 1.6–2.0V). FIG. 4 illustrates three representative curve segments for the output reference voltage FVREF based on three major groupings of supply voltage, temperature conditions, and process variables that may be found to affect FVREF.

For example, FVREF curve segment 440 represents a median supply voltage, temperature and set of process conditions affecting FVREF. FVREF 440*a* represents a high extreme supply voltage, temperature and set of process conditions, while FVREF 440*b* represents a low extreme supply voltage, temperature and set of process conditions affecting FVREF. In one exemplary testing, the fast bandgap reference voltage circuit of the present invention was evaluated using 81 various combinations of supply voltage $V_{CC}$ (e.g., 1.6, 1.8, and 2.0V), temperature (e.g., −40, 25, and 100° C.), and process variations (strong, typical, and weak PMOS combined with strong, typical, and weak BJT) wherein the curves shown in FIG. 4 are representative of the exemplary FVREF output test results.

At time $t_1$ (450), for example, about 2–3 ns after time $t_0$ (420), START signal 435 returns to a low state, removing the $V_{CC}$ forced pull-up to FVREF 305/440. The current mirror circuit of the current generator 310 begins operating to produce a regulated reference current having a $+T_C$ due to the $-T_C$ resistor R1 and the $+T_C$ of the $\Delta V_{be}$ in the current mirror circuit, while the voltage generator 320 translates the reference current into a reference voltage FVREF as FVREF approaches a final regulated value 440*c*. During this time, the smart clamping circuit 330, which comprises transistors Q4 and Q5 together with R3, quickly bring the reference voltage FVREF 305/440 down to the final regulated voltage value 440*c* especially at high temperature.

By time $t_2$ (460), the reference voltage output FVREF 305/440 is at the final regulated value 440*c*, and is enabled and output to, for example, a voltage booster circuit for a memory read operation. Typically, this may occur in about 25 ns for a 50 ns read cycle. The read access continues after $t_2$ (460) for about another 25 ns providing a regulated reference voltage output FVREF 305/440 for the reference voltage circuit 300.

Optionally, between time $t_2$ (460) and time $t_3$ (470), about 50 ns after a new address was accessed, enable EN 425 goes low, and enable-bar ENB 430 goes high again, and the reference voltage operation of the read access is completed.

Another aspect of the invention provides a methodology for providing and regulating a reference voltage of a reference operation in an electronic device, that may be employed in association with the fast bandgap reference devices illustrated and described herein, as well as with other devices. Referring now to FIG. 5, an exemplary method 500 is illustrated for regulating the reference voltage of a reference operation which may be used in a memory device. While the exemplary method 500 is illustrated and described herein as a series of acts or events, it will be appreciated that the present invention is not limited by the illustrated ordering of such acts or events, as some steps may occur in different orders and/or concurrently with other steps apart from that shown and described herein, in accordance with the invention. In addition, not all illustrated steps may be required to implement a methodology in accordance with the present invention. Moreover, it will be appreciated that the method 500 may be implemented in association with the apparatus and systems illustrated and described herein as well as in association with other systems not illustrated.

The method 500 comprises initially discharging any residual voltage or charge that may be present in current and voltage generator circuits of a fast bandgap reference voltage circuit, initializing the output reference voltage to $V_{CC}$. The method 500 further comprises generating a reference current having a positive function of temperature $+T_C$, translating the reference current into a reference voltage, and generating a clamping voltage and a load resistance. The clamping voltage is then applied to the reference voltage to limit the output of the reference voltage circuit and quickly settle the reference voltage FVREF to the final level that may be used in a voltage booster circuit.

The fast bandgap reference voltage operation method begins at 502. At 504 the current and voltage generator circuits are initially discharged of any residual potentials to the circuit ground (e.g., 0V), for example, with a high on the enable bar signal (e.g., ENB of FIG. 3), while the reference voltage circuit is disabled with a low on the enable signal (e.g., EN of FIG. 3). At 506, the FVREF output (e.g., 305 of FIG. 3) of the reference voltage circuit 300 is initialized to about the supply voltage level (e.g., $V_{CC}$), for example, with a high on the START signal input (e.g., in the current generator circuit 310 of FIG. 3). At 508, a base-emitter voltage difference $\Delta V_{be}$ is generated between transistors (e.g., Q1 and Q2 of FIG. 3) of a current mirror circuit within the current generator 310.

At 510, a resistance of a $-T_C$ resistor (e.g., R1 of FIG. 3) is varied in response to the resistor temperature. At 512 the base-emitter voltage difference $\Delta V_{be}$ between transistors Q1 and Q2, is translated into a reference current $I_C$ having a positive function of temperature $+T_C$ in response to the resistance change across R1 and the $\Delta V_{be}$. At 514, the $+T_C$ reference current $I_C$ is translated into a reference voltage VREF.

At 516, a clamping voltage is generated across the base-emitter junctions of two diode-connected transistors (e.g., Q4 and Q5 of FIG. 3), along with a load resistance (e.g., R3 of FIG. 3). Thereafter at 518, the clamping voltage and the load resistance are applied to the reference voltage to quickly limit the reference voltage, particularly at high temperatures, and provide a fast and stable regulated reference voltage FVREF (e.g., 305 of FIG. 3) that is substantially independent of supply voltage, temperature, and process variations. The fast bandgap reference voltage operation thereafter ends at 520, and the method 500 may be repeated for subsequent reference voltage operations of the device.

The methodology 500 thus provides for fast, low supply voltage, low reference voltage circuit that uses a $-T_C$ resistor and the $+T_C$ $\Delta V_{be}$ to create a lower effective partial differential of the base emitter voltage with respect to the temperature to provide a lower reference voltage. The method 500 further uses a discharge circuit to discharge any residual potentials from the reference circuit for improved output repeatability, a start circuit to initialize the FVREF output to about $V_{CC}$ for a faster settling time. In addition, the method 500 uses a smart clamping circuit responsive at high temperatures, to quickly settle the reference voltage FVREF to a stable final value over a wide range of supply voltages. The reference voltage output FVREF may be applied to, for example, a voltage booster during read operations of flash memory arrays. Therefore the method 500 generates a reference voltage FVREF that is substantially independent of variations in $V_{CC}$ supply voltage, temperature, process corners, and circuit idle periods. Other variants of methodologies may be provided in accordance with the present invention, whereby compensation or regulation of a fast reference voltage is accomplished.

Although the invention has been shown and described with respect to one or more implementations, equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the term "includes" is used in either the detailed description and the claims, such term is intended to be inclusive in a manner similar to the term "comprising."

What is claimed is:

1. A bandgap reference circuit, comprising:

a current generation circuit having a supply level start-up transistor, the current generation circuit operable to generate a reference current having a positive function of a temperature;

a voltage generation circuit connected to the current generation circuit, the voltage generation circuit operable to receive the reference current from the current generation circuit and produce a reference voltage in response to the reference current; and a smart clamping circuit connected to the voltage generation circuit, wherein the smart clamping circuit clamps the reference voltage to quickly bring the reference voltage output of the voltage generation circuit to its final value, thereby producing a fast and stable reference voltage signal; and a discharge circuit connected to the current generation circuit and the voltage generation circuit, the discharge circuit operable to initially discharge a residual potential in the current generation circuit and in the voltage generation circuit, the discharge circuit comprising:

a first MOS transistor having a first terminal connected to the current generation circuit, a second terminal connected to circuit ground, and a control terminal connected to an enable bar input terminal;

a second MOS transistor having a first terminal connected to the voltage generation circuit, a second terminal connected to circuit ground, and a control terminal connected to the enable bar input terminal and the control terminal of the first MOS transistor; and wherein the first and second MOS transistors are operable to conduct based on a signal at the control terminals to initially discharge a residual potential in the current generation circuit and in the voltage generation circuit, thereby enhancing repeatability and settling time of the output of the bandgap voltage reference circuit.

2. The circuit of claim 1, wherein the voltage generation circuit comprises:

a third MOS transistor having a first terminal, a second terminal, and a control terminal, wherein the first terminal is connected to a voltage supply, and the control terminal is connected to the current generation circuit and the first terminal of the start-up transistor;

a second resistance having a first terminal and a second terminal, wherein the first terminal is connected to the second terminal of the third MOS transistor and the second terminal is connected to circuit ground; and operable to mirror current from the current generation circuit using the third MOS transistor as a current mirror and translate the current from the current generation circuit to a voltage by conducting the current through the second resistance, whereby the first terminal of the second resistance forms the output of the bandgap voltage reference circuit.

3. The circuit of claim 1, wherein the current generation circuit comprises:

a current mirror having a first leg and a second leg;

a first bipolar transistor having a collector terminal connected to the first leg of the current mirror, an emitter terminal connected to circuit ground, and a base terminal;

a second bipolar transistor having a collector terminal connected to the second leg of the current mirror, a base terminal connected to the base terminal of the first bipolar transistor, and an emitter terminal, the first bipolar transistor having a different size than the second bipolar transistor;

a first resistance having a first terminal and a second terminal, the first terminal connected to the emitter terminal of the first bipolar transistor and the second terminal connected to circuit ground;

a supply level start-up transistor having a first terminal, a second terminal, and a control terminal, the first terminal connected to the first leg of the current mirror, the voltage generation circuit, and the base terminals of MOS transistors for the current mirror and the voltage generation circuit, the second terminal connected to circuit ground, and the control terminal connected to a start-up input terminal, wherein the supply level start-up transistor initially provides base drive to the MOS transistors for substantially full conduction in the current mirror and the voltage generation circuit to start the reference circuit at about the level of the supply voltage; and operable to generate a current in the first leg of the current mirror that is a function of a difference in the base-emitter voltages of the first and second bipolar transistors and a magnitude of the first resistance.

4. The circuit of claim 3, wherein the first resistance comprises a polysilicon material having a negative temperature coefficient, wherein the reference current having the positive function of the temperature is provided.

5. The circuit of claim 3, wherein the current mirror comprises:

a first MOS transistor having a first terminal, a second terminal, and a control terminal, wherein the first terminal is connected to the supply voltage, the second terminal is connected to the collector terminal of the first bipolar transistor and forms the first leg of the current mirror, and a control terminal connected to the second terminal of the first MOS transistor; and a second MOS transistor having a first terminal, a second terminal, and a control terminal, wherein the first terminal is connected to the voltage supply, the second terminal is connected to the collector terminal of the second bipolar transistor and forms the second leg of the current mirror, and a control terminal connected to the control terminal of the first MOS transistor.

6. The circuit of claim 5, wherein the second resistance comprises:

a resistor having a first terminal and a second terminal, wherein the first terminal forms the first terminal of the second resistance; and a diode having an anode and a cathode, wherein the anode is connected to the second terminal of the resistor, and the cathode forms the second terminal of the second resistance.

7. The circuit of claim 6, wherein the diode comprises a bipolar transistor having a collector terminal, a base terminal, and an emitter terminal, wherein the collector terminal is connected to the base terminal and forms the anode of the diode and the emitter terminal forms the cathode of the diode.

8. A bandgap reference circuit, comprising:

a current generation circuit having a supply level start-up transistor, the current generation circuit operable to generate a reference current having a positive function of a temperature;

a voltage generation circuit connected to the current generation circuit, the voltage generation circuit operable to receive the reference current from the current generation circuit and produce a reference voltage in response to the reference current; and a smart clamping circuit connected to the voltage generation circuit, wherein the smart clamping circuit clamps the reference voltage to quickly bring the reference voltage output of the voltage generation circuit to its final value, thereby producing a fast and stable reference voltage signal;

wherein the smart clamping circuit comprises:

a third resistor having a first terminal and a second terminal, wherein the first terminal forms the first terminal of the second resistance of the voltage generation circuit and the output of the bandgap voltage reference circuit;

first and second diodes connected in series, each diode having an anode and a cathode, wherein the anode of the first diode is connected to the second terminal of the third resistor, the cathode of the first diode is connected to the anode of the second diode, and the cathode of the second diode is connected to circuit ground; and operable to quickly bring the reference voltage output of the voltage generation circuit to its final value, wherein a voltage drop across the first and second diodes provides a portion of the clamping voltage and the voltage drop across the third resistor controls a voltage error associated with the clamping circuit, and wherein the clamping circuit provides a variable voltage limit for the clamping of the reference voltage in response to the temperature of the first and second diodes.

9. A method of providing a stable reference signal, comprising:

discharging a residual potential at a first bipolar transistor and at a first diode;

initializing the reference signal at about a voltage level of the supply voltage;

generating a base-emitter voltage difference between a base-emitter voltage of the first bipolar transistor and a base-emitter voltage of a second bipolar transistor;

varying a resistance of a negative temperature coefficient resistor having a negative function of a temperature of the resistor;

translating the difference in base-emitter voltages of the two bipolar transistors into a reference current having a positive function of the temperature, wherein the reference current is a function of the difference in base-emitter voltages of the two bipolar transistors and the resistance of a negative temperature coefficient resistor having a negative function of the resistor temperature;

translating the reference current having a positive function of the temperature to a reference voltage;

generating a clamping voltage and a load resistance; and applying the clamping voltage and the load resistance to the reference voltage, wherein the clamping and loading of the reference voltage produces a fast and stable reference signal that is substantially independent of variations in supply voltage, and process variations;

wherein generating a clamping voltage and a load resistance comprises:

providing a voltage across a base-emitter junction of one or more diode-connected transistors;

exposing the one or more diode-connected transistors to the temperature;

generating a voltage across the one or more diode-connected transistors;

applying the reference voltage from the voltage generation circuit to a load resistor and the one or more diode-connected transistors, wherein the load resistor and the one or more diode-connected transistors form a smart clamping circuit;

generating a voltage difference across the load resistor based on the sum of the reference voltage and the voltage across the one or more diode-connected transistors; and wherein the voltage difference across the load resistor provides a variable load current to the reference voltage, wherein the clamping and loading of the reference voltage forms a stable reference signal that is substantially independent of variations in supply voltage, and process variations.

10. The method of claim 9, wherein generating a base-emitter voltage difference comprises:

conducting a first current through the first bipolar transistor, the first bipolar transistor exhibiting a first current density; and conducting a second current through the second bipolar transistor, the second bipolar transistor exhibiting a second current density, wherein the first current is approximately equal in magnitude to the second current and the first current density to larger than the second current density.

11. The method of claim 9, wherein the translating the difference between the base-emitter voltages of the first bipolar transistor and the second bipolar transistor into a reference current comprises the step of placing the difference between the base-emitter voltages of the first bipolar transistor and the second bipolar transistor across a negative temperature coefficient resistance, wherein the reference current is a function of the magnitude of the difference between the base-emitter voltages of the first bipolar transistor and the second bipolar transistor, the magnitude of the resistance, the magnitude of the negative temperature coefficient of the resistor, and the magnitude of the temperature.

12. The method of claim 9, wherein varying a resistance of a negative temperature coefficient resistor having a negative function of a temperature of the resistor comprises exposing the resistor to the temperature.

13. The method of claim 9, wherein generating a clamping voltage comprises:

providing a voltage across a diode junction or a diode-connected transistor; and exposing the diode or diode-connected transistor to the temperature.

14. The method of claim 9, wherein translating the reference current having a positive function of the temperature to a reference voltage comprises:

applying the reference current to the base of an appropriately sized first MOS transistor in a voltage generation circuit;

providing a voltage across a base-emitter junction of a diode-connected transistor;

exposing the diode-connected transistor to the temperature;

generating a voltage across a resistor and the diode-connected transistor of the voltage generation circuit in response to the temperature of the diode-connected transistor; and wherein a voltage produced at a connection between the first MOS transistor and the resistor within the voltage generation circuit forms the reference voltage.

15. A bandgap reference circuit, comprising:

a current generation circuit operable to generate a reference current having a positive function of a temperature;

a voltage generation circuit connected to the current generation circuit, the voltage generation circuit operable to receive the reference current from the current generation circuit and produce a reference voltage in response to the reference current;

a smart clamping circuit connected to the voltage generation circuit, wherein the smart clamping circuit clamps the reference voltage to quickly bring the reference voltage output of the voltage generation circuit to its final value, thereby producing a fast and stable reference voltage signal; and a discharge circuit connected to the current generation circuit and the voltage generation circuit, the discharge circuit operable to initially discharge a residual potential in the current generation circuit and in the voltage generation circuit, the discharge circuit comprising:

a first MOS transistor having a first terminal connected to the current generation circuit, a second terminal connected to circuit ground, and a control terminal connected to an enable bar input terminal;

a second MOS transistor having a first terminal connected to the voltage generation circuit, a second terminal connected to circuit ground, and a control terminal connected to the enable bar input terminal and the control terminal of the first MOS transistor; and wherein the first and second MOS transistors are operable to conduct based on a signal at the control terminals to initially discharge a residual potential in the current generation circuit and in the voltage generation circuit, thereby enhancing repeatability and settling time of the output of the bandgap voltage reference circuit.

16. The circuit of claim 15, wherein the current generation circuit comprises:

a current mirror having a first leg and a second leg;

a first bipolar transistor having a collector terminal connected to the first leg of the current mirror, an emitter terminal connected to circuit ground, and a base terminal;

a second bipolar transistor having a collector terminal connected to the second leg of the current mirror, a base terminal connected to the base terminal of the first bipolar transistor, and an emitter terminal, the first bipolar transistor having a different size than the second bipolar transistor;

a first resistance having a first terminal and a second terminal, the first terminal connected to the emitter terminal of the first bipolar transistor and the second terminal connected to circuit ground;

a supply level start-up transistor having a first terminal, a second terminal, and a control terminal, the first terminal connected to the first leg of the current mirror, the voltage generation circuit, and the base terminals of MOS transistors for the current mirror and the voltage generation circuit, the second terminal connected to circuit ground, and the control terminal connected to a start-up input terminal, wherein the supply level start-up transistor initially provides base drive to the MOS transistors for substantially full conduction in the current mirror and the voltage generation circuit to start the reference circuit at about the level of the supply voltage; and operable to generate a current in the first leg of the current mirror that is a function of a difference in the base-emitter voltages of the first and second bipolar transistors and a magnitude of the first resistance.

17. The circuit of claim 16, wherein the current mirror comprises:

a first MOS transistor having a first terminal, a second terminal, and a control terminal, wherein the first terminal is connected to the supply voltage, the second terminal is connected to the collector terminal of the first bipolar transistor and forms the first leg of the current mirror, and a control terminal connected to the second terminal of the first MOS transistor; and a second MOS transistor having a first terminal, a second terminal, and a control terminal, wherein the first terminal is connected to the voltage supply, the second terminal is connected to the collector terminal of the second bipolar transistor and forms the second leg of the current mirror, and a control terminal connected to the control terminal of the first MOS transistor.

18. The circuit of claim 16, wherein the first resistance comprises a polysilicon material having a negative temperature coefficient, wherein the reference current having the negative function of the temperature is provided.

19. The circuit of claim 15, wherein the voltage generation circuit comprises:

a third MOS transistor having a first terminal, a second terminal, and a control terminal, wherein the first terminal is connected to a voltage supply, and the control terminal is connected to the current generation circuit and the first terminal of the start-up transistor;

a second resistance having a first terminal and a second terminal, wherein the first terminal is connected to the second terminal of the third MOS transistor and the second terminal is connected to circuit ground; and operable to mirror current from the current generation circuit using the third MOS transistor as a current mirror and translate the current from the current generation circuit to a voltage by conducting the current through the second resistance, whereby the first terminal of the second resistance forms the output of the bandgap voltage reference circuit.

20. The circuit of claim 19, wherein the second resistance comprises:

a resistor having a first terminal and a second terminal, wherein the first terminal forms the first terminal of the second resistance; and a diode having an anode and a cathode, wherein the anode is connected to the second terminal of the resistor, and the cathode forms the second terminal of the second resistance.

21. The circuit of claim 20, wherein the diode comprises a bipolar transistor having a collector terminal, a base terminal, and an emitter terminal, wherein the collector terminal is connected to the base terminal and forms the anode of the diode and the emitter terminal forms the cathode of the diode.

22. A bandgap reference circuit, comprising:

a current generation circuit operable to generate a reference current having a positive function of a temperature;

a voltage generation circuit connected to the current generation circuit, the voltage generation circuit operable to receive the reference current from the current generation circuit and produce a reference voltage in response to the reference current;

a smart clamping circuit connected to the voltage generation circuit, wherein the smart clamping circuit clamps the reference voltage to quickly bring the reference voltage output of the voltage generation circuit to its final value, thereby producing a fast and stable reference voltage signal; and a current generation circuit having a supply level start-up transistor, the current generation circuit operable to generate a reference current having a positive function of a temperature comprising:

a MOS transistor having a first terminal, a second terminal, and a control terminal, the first terminal connected to the current generation circuit, and the voltage generation circuit, the second terminal connected to circuit ground, and the control terminal connected to a start-up input terminal, wherein the supply level start-up transistor initially produces substantially full conduction in the current and voltage generation circuits to start the reference circuit at about the level of the supply voltage.

23. A bandgap reference circuit, comprising:

a current generation circuit operable to generate a reference current having a positive function of a temperature;

a voltage generation circuit connected to the current generation circuit, the voltage generation circuit operable to receive the reference current from the current generation circuit and produce a reference voltage in response to the reference current;

a smart clamping circuit connected to the voltage generation circuit, wherein the smart clamping circuit clamps the reference voltage to quickly bring the reference voltage output of the voltage generation circuit to its final value, thereby producing a fast and stable reference voltage signal, wherein the smart clamping circuit comprises:

a third resistor having a first terminal and a second terminal, wherein the first terminal forms the first terminal of the second resistance of the voltage generation circuit and the output of the bandgap voltage reference circuit;

first and second diodes connected in series, each diode having an anode and a cathode, wherein the anode of the first diode is connected to the second terminal of the third resistor, the cathode of the first diode is connected to the anode of the second diode, and the cathode of the second diode is connected to circuit ground; and operable to quickly bring the reference voltage output of the voltage generation circuit to its final value, wherein a voltage drop across the first and second diodes provides a portion of the clamping voltage and the voltage drop across the third resistor controls a voltage error associated with the clamping circuit, and wherein the clamping circuit provides a variable voltage limit for the clamping of the reference voltage in response to the temperature of the first and second diodes.

* * * * *